United States Patent [19]

Van Der Sande et al.

[11] 4,409,517

[45] Oct. 11, 1983

[54] HIGH-PRESSURE DISCHARGE LAMP WITH ENVELOPE LEAD-THROUGH STRUCTURE

[75] Inventors: Johannes H. M. Van Der Sande; Franciscus G. P. Sools, both of Eindhoven, Netherlands; Ronald J. Campbell, Pennington, N.J.

[73] Assignee: U.S. Philips Corporation, New York, N.Y.

[21] Appl. No.: 264,746

[22] Filed: May 18, 1981

[30] Foreign Application Priority Data

Jun. 3, 1980 [NL] Netherlands ..... 8003216

[51] Int. Cl.[3] ..... H01J 61/12; H01J 61/36

[52] U.S. Cl. ..... 313/631; 313/634; 313/637

[58] Field of Search ..... 313/217, 220, 229, 631, 313/634, 637, 638

[56] References Cited

U.S. PATENT DOCUMENTS

| | | | |
|---|---|---|---|
| 3,832,590 | 8/1974 | Yamazaki et al. | 313/220 X |
| 3,911,308 | 10/1975 | Akutsu et al. | 313/221 X |
| 4,001,625 | 1/1977 | Schat et al. | 313/221 X |
| 4,052,635 | 10/1977 | Jacobs | 313/217 |

*Primary Examiner*—Palmer C. Demeo

*Attorney, Agent, or Firm*—Robert S. Smith

[57] ABSTRACT

The invention relates to a high-pressure discharge lamp for use in the vertical position, having a tubular ceramic discharge vessel, the electrodes being connected to current lead-through members which have been provided one at each end of the discharge vessel, a first, upper current lead-through member consisting of material which is resistant to attack by halogens and/or halides, for example molybdenum, and a second, lower current lead-through member comprising a hydrogen-permeable material, for example niobium.

5 Claims, 2 Drawing Figures

HIGH-PRESSURE DISCHARGE LAMP WITH ENVELOPE LEAD-THROUGH STRUCTURE

Figure 1:
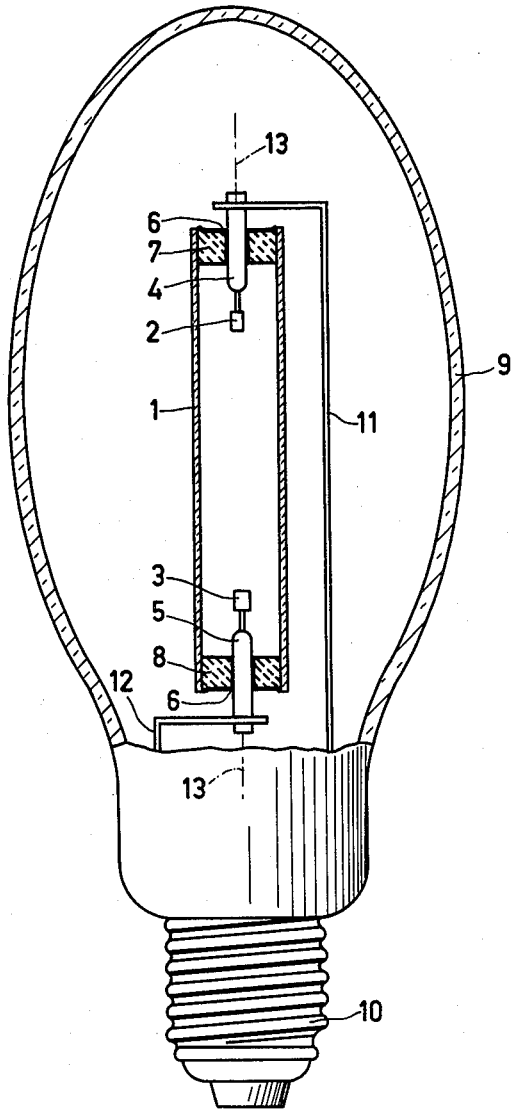

The invention relates to a high-pressure discharge lamp for use in the vertical position having a ceramic tubular discharge vessel which is sealed in a vacuum-tight manner, the longitudinal axis not deviating by more than 45° from the vertical in use, the discharge vessel containing a gas filling comprising a halogen and/or a halide, electrodes having been arranged one each at the ends of the discharge vessel, the discharge being maintained between these electrodes during operation of the lamp, each electrode being connected to a current leadthrough member included in the discharge vessel wall. Such a lamp is disclosed in United Kingdom Patent Specification No. 1,374,063.

It is known to add to the gas filling of high-pressure discharge lamps, particularly high-pressure mercurydischarge lamps, one or more halides in order to enhance the luminous flux and/or the color rendition of the lamp. In order to render it possible to achieve a higher vapor pressure with such halides and/or to render the use of relatively aggressive halides possible, the above-mentioned Patent Specification describes a discharge vessel consisting of a ceramic material instead of the commonly used quartz. This ceramic material consists preferably of aluminum oxide which in the densely sintered, poly-crystalline form or in the form of a saphire has a high transmission to visible radiation. In addition, it can be heated without inconvenience to a high temperature, for example 1200° C., and it is resistant to many halides. Halides with which only comparatively low vapor pressures can be achieved in quartz are, for example, sodium iodide, alkaline earth metal iodides and rare earth metal iodides. Halides which, in combination with quartz, may result in attack of quartz are, for example, cadmium iodide, aluminum iodide, lanthanum iodide, yttrium iodide and many more corosive bromides and chlorides.

An electrode in a lamp whose discharge vessel mainly consists of a ceramic material, such as transparent densely-sintered aluminum oxide is supplied with current by means of a current lead-through member, which is connected to the discharge vessel in a vacuum-tight manner by means of a suitable sealing material. A suitable sealing material is, for example, a glass which contains a mixture of $Al_2O_3$ and some rare earth metal oxides (see U.S. Pat. No. 3,588,573).

The lead-through members in the known lamps are in the form of a solid pin or a can and consist of a high-melting point metal, such as molybdenum. Although niobium is very often used as the material for lead-through elements in ceramic discharge vessels, it has appeared that it is not so suitable for use in lamps the discharge vessel of which contains halides as niobium is attacked by many halides (and by the halogens formed during operation of the lamp). Furthermore, it appeared that blackening of the discharge vessel wall occurred in the region of the niobium lead-through element. Compared with molybdenum, niobium has indeed the advantage that the said phenomena do not occur, but the use of molybdenum as the material for the lead-through element has the drawback, contrary to niobium, that its coefficient of expansion differs to a relatively high extent from the coefficient of expansion of the ceramic material of the wall of the discharge vessel. During use this may easily abuse the occurrence of stresses between the lead-through element and the said ceramic wall, so that the risk of leaks is not inconceivable. Molybdenum has the additional drawback that it is only little permeable to hydrogen.

It was found that the presence in the discharge vessel of gaseous contaminations in general, and of hydrogen in particular, is very annoying. These contaminations can be introduced during production of the lamps (for example during evacuation of the lamp), but it is alternatively possible that these gasses are released from components of the discharge vessel or the gas filling during lamp life. Even very small quantities of hydrogen in the discharge vessel result in a considerable increase of the (re)-ignition voltage. In order to obviate this drawback it is known to use a hydrogen getter (for example consisting of zirconium) in the lamp. A getter which is located within the discharge vessel entails the risk that during operation of the lamp the getter is attacked by the gasses contained in the discharge vessel. Preferably, such a getter is therefore provided in a position outside the ceramic discharge vessel but within an outer bulb enveloping the discharge vessel. It is then necessary that transport of hydrogen occurs from the discharge vessel to the outer bulb.

A ceramic wall is less permeable to hydrogen than is, for example, quartz. Measures must therefore be taken to allow the hydrogen to leave the discharge vessel via other means. It was surprisingly found that a lead-through element is suitable for this purpose, particularly a lead-through element containing material which is highly permeable to hydrogen, such as niobium. For the above-mentioned reasons this metal is, however, less suitable for use in a discharge vessel ontaining a gas mixture which comprises a halide.

It is an object of the invention to provide a halogen-containing lamp with a ceramic discharge vessel, in which the disadvantages of the known lamps are at least mitigated, in which there is no corosion of a lead-through element and in which unwanted gasses, such as hydrogen, can easily leave the discharge vessel.

According to the invention, a high-pressure discharge lamp for use in the vertical position, of the type mentioned in the opening paragraph, is characterized in that the current lead-through element located at the upper end of the discharge vessel consists, at least at its surface facing the discharge, of a material which is resistant to attack by halogens and/or halides, and the current lead-through element located at the other, lower end of the discharge vessel contains a material which is highly permeable to hydrogen.

The invention is based on the recognition of the fact that in a discharge vessel whose longitudinal axis does not deviate by more than 45° from the vertical during operation, the relatively immobile halide molecules (for example iodide molecules) move upward with a low coefficient of diffusion with the convection current towards the upper electrode. This causes the relatively light metal atoms (for example sodium or indium) to diffuse to the region of the lower electrode. In a lamp according to the invention a chemical reaction between the reactive halide molecules and the halogen atoms produced during operation and the metal of the lower lead-through element is prevented from occurring. It was found that the said advantageous effects do not occur at greater deviations from the vertical than 45° (for example 60°).

Consequently, the upper lead-through element must be resistant to attack by the said halogens and/or halides. Molybdenum or tungsten are examples of such a metal. It appeared that the lower lead-through element may consist of a material having a relatively high permeability to hydrogen but need not of necessity be resistant to the aggressive halogens and/or halides. The lower lead-through element consists, for example of niobium and/or tantalum. Niobium is not only highly permeable to hydrogen but also has a coefficient of expansion which is approximately equal to the coefficient of expansion of densely sintered aluminum oxide. Additionally, niobium is a suitable getter for other unwanted gasses, such as oxygen, nitrogen and carbon monoxide, present in the discharge vessel.

In an embodiment of a high-pressure discharge lamp according to the invention, the upper lead-through element consists of niobium on which a shield or cover is disposed. The cover faces the discharge and consists of a material which is resistant to attack by halogens and/or halides has been provided. This embodiment has the advantage that also the upper lead-through element may consist of a material (niobium) which has a coefficient of expansion which compares favorably with that of the said aluminum oxide. The shield consists of, for example, glass which is resistant to attack by halogens and/or halides. Alternatively, the screen may consist of a thin layer of molybdenum provided on the niobium wall, for example by means of vacuum deposition. Preferably, the shield is formed by a molybdenum cap which covers the lead-through element (consisting of, for example, a niobium can) and sealing glass to connect the cap to the lead-through element.

Figure 2:
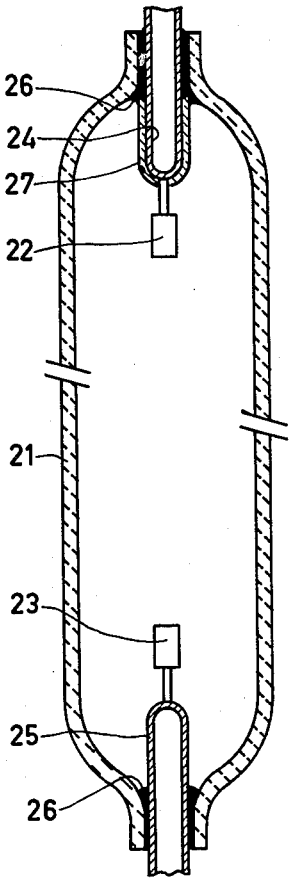

Embodiments of high-pressure discharge lamps according to the invention will now be further explained with reference to the accompanying drawing, of which, FIG. 1 shows schematically an embodiment of a high-pressure mercury vapor discharge lamp according to the invention, partly in a side elevational view, partly in longitudinal section, and FIG. 2 shows a longitudinal section through a discharge vessel of a different embodiment of the discharge vessel of a high-pressure mercury vapor discharge lamp.

The lamp shown in FIG. 1 comprises a tubular discharge vessel 1, which is sealed in vacuum-tight manner and whose wall consists of transparent densely sintered polycrystalline aluminum oxide. The discharge vessel has a gas filling of mercury and a rare gas, as well as one or more halides. Electrodes 2 and 3 between which a discharge is maintained during operation of the lamp are arranged one each at the ends of the discharge vessel. Each electrode is connected to a current lead-through element (4 and 5, respectively). These current lead-through elements are connected to a ceramic plug 7 and 8, respectively, by means of sealing glass 6, which is resistant to the gas atmosphere present in the discharge vessel. This glass consists of, for example, $Al_2O_3$, $La_2O_3$ and $SiO_2$ as described in, inter alia, U.S. Pat. No. 4,122,042. The plugs 7 and 8, respectively, are connected to the wall of the discharge vessel in a vacuum-tight manner by means of a sintered joint (see, for example, German Patent Specification No. 2,814,411. The discharge vessel is enveloped by an outer bulb 9 which has a lamp base 10. In addition, this outer bulb contains current leads 11 and 12, which are connected to the lead-through elements 4 and 5, respectively. During operation of the lamp the discharge vessel 1 is in such a position that the longitudinal axis does not deviate by more than 45° from the vertical. By way of example, the longitudinal axis 13 of the discharge vessel 1 coincides in the drawing with the vertical. The lamp must be assumed to be in an upright position, the lamp base 10 being at the bottom.

The current lead-through element 4 which is then located at the upper end of the discharge vessel 1 comprises a molybdenum can, which is resistant to attack by halogens (such As $I_2$, $Br_2$, $Cl_2$) and/or halides (such as $HgI_2$, NaI, TlI). The current lead-through element 5 provided at the other, lower end of the discharge vessel consists of niobium, which has a high permeability to hydrogen but is little resistant to halogen and/or halides during operation. The hydrogen in the discharge vessel flows via the lead-through element 5 to the space )which may include a hydrogen getter) between the discharge vessel and the outer bulb. Because of the position of the discharge vessel, the relatively agressive halides (and the halogens formed) which have a low coefficient of diffusion move with the convection current towards the lead-through element 4 during operation of the lamp. The light metal atoms diffuse to the region of lead-through element 5 during operation.

In a practical embodiment of the above-described lamp the discharge vessel 1 is filled with a pressure of 5300 Pa (40 Torr) of argon and further with 0.4 mg of indium, 17.5 mg of mercury, 3.7 mg of thallium iodide, 30 mg of sodium iodide and 2 mg of mercury iodide. The discharge vessel has a length of approximately 49 mm and an inside diameter of approximately 11.5 mm (electrode spacing 33 mm). During operation the lamp shown in FIG. 1 consumes a power of approximately 400 W. A luminous efficiency of approximately 80 lm/W was measured.

In FIG. 2, the ceramic discharge vessel whose ends are somewhat hemispherical is denoted by reference 21. The electrodes between which the discharge takes place during operation are denoted by 22 and 23. The current lead-through members 24 and 23 (niobium) have been secured in the discharge vessel by means of sealing glass 26. The upper current lead-through member 24 is provided at the surface which faces the discharge with a molybdenum cap 27 which serves as a shield for the niobium. It prevents the niobium current lead-throughmember 24 from being attacked by halogens and/or halides during operation of the lamp. The cap 27 is connected to member 24 by means of a spot-welded joint with the aid of a sealing glass, the same glass as sealing glass 26 (for example the glass mentioned in the foregoing and which is in accordance with U.S. Pat. No. 4,122,042). The construction is such that the gas atmosphere does not contact the niobium wall of the current lead-through member 24.

What is claimed is:

1. A high-pressure discharge lamp for use in the vertical position having a ceramic tubular discharge vessel which is sealed in a vacuum-tight manner, the longitudinal axis of which does not deviate by more than 45° from the vertical in use, the discharge vessel containing a gas filling containing a halogen and/or halide, respective electrodes disposed at the ends of the discharge vessel, the discharge being maintained between these electrodes during operation of the lamp, each electrode being connected to a current lead-through member included in the discharge vessel wall, the current lead-through member located at the upper end of the discharge vessel consists at least at its surface facing the discharge, of a material which is resistant to attack by halogens and/or halides, and that the current leadthrough member located at the other, lower end of the discharge vessel contains a material which is highly permeable to hydrogen and which would be attacked by a halogen and/or a halide if used at the upper end.

2. A high-pressure discharge lamp as claimed in claim 1, characterized in that the upper current lead-through member comprises molybdenum and/or tungsten and the lower current lead-through member comprises niobium and/or tantalum.

3. A high-pressure discharge lamp as claimed in claim 1, characterized in that the upper current lead-through member comprises niobium and is provided with a cover which faces the discharge said cover is composed essentially of a material which is resistant to attack by halogens and/or halides.

4. A high-pressure discharge lamp as claimed in claim 3, characterized in that said cover is formed by a molybdenum cap which is situated on the lead-through member and of sealing glass for connecting the cap to the lead-through member.

5. A high-pressure discharge lamp as claimed in claim 3 wherein said cover consists of material which is resistant to attack by halogens and/or halides.

* * * * *